United States Patent [19]

Schäfer et al.

[11] Patent Number: 4,785,301

[45] Date of Patent: Nov. 15, 1988

[54] METHOD FOR PRODUCING A RADAR REFLECTOR

[75] Inventors: Marlene Schäfer, Mailänder Str. 7, 6000 Frankfurt/Main 70; Wilhelm Schuster; Jürgen Stahl, both of Frankfurt am Main, all of Fed. Rep. of Germany

[73] Assignee: Marlene Schäfer, Frankfurt am Main, Fed. Rep. of Germany

[21] Appl. No.: 943,721

[22] Filed: Dec. 19, 1986

[30] Foreign Application Priority Data

Dec. 19, 1985 [DE] Fed. Rep. of Germany ..... 3545096

[51] Int. Cl.[4] ..... H01Q 15/18

[52] U.S. Cl. ..... 342/7

[58] Field of Search ..... 342/7

[56] References Cited

U.S. PATENT DOCUMENTS 4,096,479 6/1978 Van Buskirk ..... 342/7

4,531,128 7/1985 Mensa et al. ..... 342/7

FOREIGN PATENT DOCUMENTS 2308701 9/1974 Fed. Rep. of Germany ..... 342/7

*Primary Examiner*—T. H. Tubbesing

*Attorney, Agent, or Firm*—Franklin D. Wolffe; Morris Fidelman

[57] ABSTRACT

A method for producing a spherical radar reflector containing triple reflectors and composed of identically shaped eighths of a sphere is described. The eighths of the sphere consist of foam material and their plane surface, which are in contact with each other, are constructed to be reflecting. The eighths of the sphere are individually expansion molded in appropriate molds and the plane surfaces of the eighths of the sphere are covered with material reflecting radar rays. This material can consist of metal foils or can be a mixture of an adhesive and of metal particles which are uniformly distributed in the adhesive.

7 Claims, 1 Drawing Sheet

METHOD FOR PRODUCING A RADAR REFLECTOR

Figure 1:
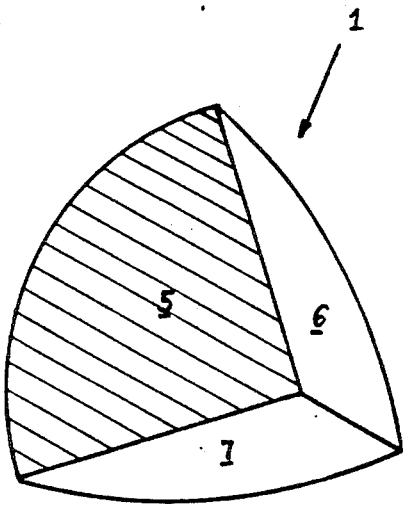

The invention relates to a method for producing a spherical radar reflector composed of identically shaped eighths of a sphere containing triple or corner reflectors, the eighths of a sphere consisting of foam material and their plane surfaces, which are in contact with each other, being constructed to be reflecting.

Radar reflectors are important markers, particularly on shipping and sea routes where, as widely visible distinct beacons, they ensure safety in boat and shipping traffic.

Numerous embodiments of radar reflectors have been proposed and become known but only a few operate reasonably satisfactorily. To obtain a good reflector effect, accurate maintenance of the right angles of the surfaces perpendicular to each other in corners and unblemished reflector surfaces are of particular significance. However, it is precisely these characteristics which lack perfection in the known radar reflectors and which have defects. The most suitable shape of a reflector body, which also influences the reflection characteristics, has been found to be a sphere.

German Patent Specification No. 2,308,701 describes a method for producing a spherical radar reflector in which a rigid foam sphere is divided, that is to say cut, into identically shaped eighths. The plane cutting surfaces produced during this process are provided with reflector plates. However, when such a rigid foam sphere is cut apart, pores of the foam are inevitably opened at the cutting surfaces, which changes the characteristics of the surface and thus impairs the reflection. To this is added that, when a sphere is cut into eighths, there is no reliable guarantee that the angular position of the reflecting plane surfaces is always accurately maintained.

The present invention has the object of creating a method for producing a radar reflector which makes it possible to create a reflector body of the type initially mentioned in which the reflecting plane surfaces of the eighths of the sphere are in every case arranged in an accurate angular position with respect to each other and, in addition, have smooth surfaces which can be properly and durably covered with reflector material.

This object is achieved by a method of the type initially mentioned, by the fact that each individual eighth part of the sphere is expansion molded in an appropriate mold having surfaces which are smooth on all sides and, after the expansion molding, material reflecting radar rays is bonded to the plane surfaces.

The expansion molding of the individual eighths of the sphere in molds guarantees extremely accurate shaping of the parts with smooth surfaces. The singlepiece production ensures that the angular position of each eighth of the sphere is always maintained most accurately. To this is added that during the expansion molding in molds, a tearing open of the pores, which cannot be avoided when cutting a foam material, is eliminated. Smooth surfaces produced in this manner do not need to be covered with reflector plates. Instead, reflecting coating compounds or metal foils can be used. Reflector surfaces equipped in this manner guarantee an optimum effect and to a high degree meet the requirements set for radar reflectors. They are still effortlessly visible at a distance of the required 4.3 nautical miles. To this is added that the eighths of the sphere can be produced with different volume weights so that, by selecting appropriate eighths of the sphere, a weight distribution can be obtained which imparts the necessary stability to the radar reflector whilst maintaining the lowest possible weight. A large force acts on the mounting elements, which, as a rule, are located at the bottom, which is the reason why these elements must be particularly rigid. On the other hand, however, the total weight of the reflector body should be sufficiently light to avoid top-heaviness. In separately producing the eighths of the sphere the volume weight of each eighth of the sphere can be appropriately selected so that heavier eighths can be used for the mounting elements than for the remaining eighths of the sphere. In this manner, the two characteristics desired for a reflector body, those of strength and lightness, can be combined without problems and without additional economic expenditure. Radar reflectors produced in accordance with the invention, therefore, can also be solidly mounted at the highest positions of boats and ships. The production method according to the invention ensures the highest accuracy and permanence for the right angles of the reflector surface which are essential to the function of the triple reflectors. This ensures full functioning capability even when the reflector body is subjected to shock and vibration loads which are of such an intensity that even an external enclosure of the body would be damaged. Such an external enclosure suitably consists of fiber glass-reinforced polyester and thus corresponds to the material from which seawaterresistant yachts, sporting boats and closed lifeboats are produced.

The drawings show in

Figure 2:
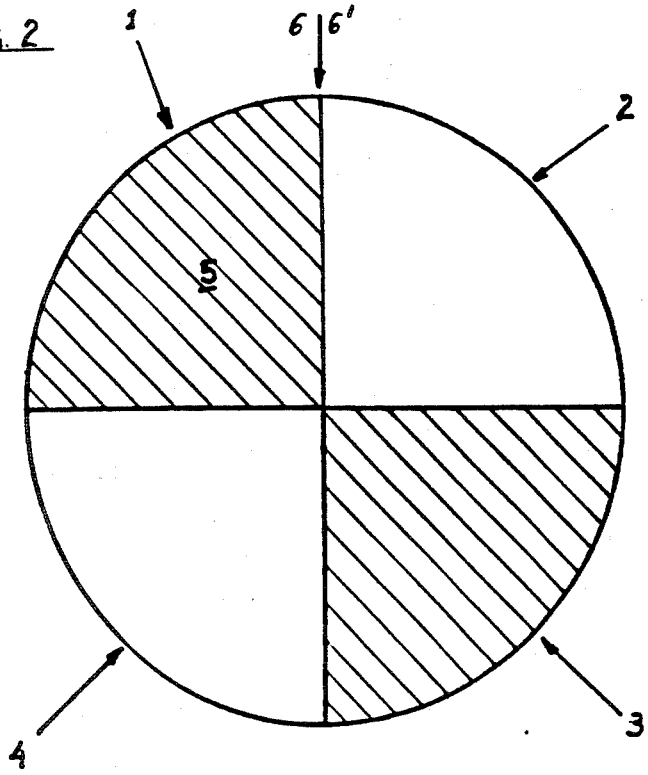

FIG. 1 a perspective view of an eighth of a sphere, looking in the direction of its apex; and in FIG. 2 a top view of the circular area of a half of a sphere of the radar reflector with four abutting circle segments.

Each eighth of a sphere 1, 2, 3, 4 is produced by expansion molding in standardized molds, which ensures that all eighths taken from the mold are identical. The three plane surfaces 5, 6, 7 (FIG. 1) of an eighth 1 of the sphere are used as support for the material reflecting radar rays and result in a triple reflector arrangement.

The material reflecting radar rays can be a thin metal foil which rests closely against the plane surfaces 6/6', which are at contact with each other, of two adjacent eighths ½.

A preferred material consists of an adhesive in which the particles of a metal reflecting radar rays are uniformly distributed. The mixture of adhesive and metal particles is applied to a plane surface 6 of an eighth 1 of a sphere and the adjacent eighth 2 of the sphere is pressed with its corresponding plane surface 6' against the plane surface 6 of the first eighth 1 of the sphere. The adhesive is thus used as carrier for the reflecting particles and simultaneously as bonding agent by means of which the reflecting plane surfaces of adjacent eighths are bonded to each other. To optimize the reflecting effect, a conductive material in the form of microfine particles is also added to the mixture of adhesive and reflecting metal particles. Extremely small quantities of such a material finely distributed in the submicron range are sufficient to generate almost complete conductivity in the reflecting layer applied to the plane surfaces. Due to the microfine structure of the electrically conductive material additionally incorporated, for example conductive carbon black, any intermediate spaces possibly occurring between metal particles are bridged so that a desired uninterrupted activity is achieved. Suitable metal particles are, for example, aluminum powder in platelet form.

We claim:

1. A process for producing a spherical radar reflector, comprising:

expansion molding eight individual and identically-shaped eighths of a sphere in a mold having smooth sides, each eighth of a sphere being made of foam material and having three mutually perpendicular plane surfaces;

bonding a material which reflects radar rays to the plane surfaces of each eighth of a sphere; and bonding the eighths of a sphere together to form the spherical radar reflector.

2. A process as claimed in claim 1, wherein said material which reflects radar rays comprises an adhesive having metallic particles uniformly distributed therein, and wherein said adhesive is applied to the plane surfaces of each eighth of a sphere so as to bond said eighths of a sphere together.

3. A process as claimed in claim 1, wherein the step of bonding a material which reflects radar rays comprises adhering metal foils to the plane surfaces of each eighth of a sphere.

4. A process for producing a spherical reflector, comprising:

expansion molding eight individual and identically-shaped eighths of a sphere in a mold having smooth sides, each eighth of a sphere being made of foam material and having three mutually perpendicular plane surfaces;

bonding a material which reflects radar rays to the plane surfaces of each eighth of a sphere; and bonding the eighths of a sphere together to form the spherical radar reflector;

wherein the step of bonding a material which reflects radar rays comprises applying an adhesive having metallic particles and another electrically conductive metal uniformly distributed therein to the plane surfaces of each eighth of a sphere so as to bond said eighths of a sphere together.

5. A process for producing a spherical radar reflector, comprising:

expansion molding eight individual and identically-shaped eighths of a sphere in a mold having smooth sides, each eighth of a sphere being made of foam material and having three mutually perpendicular plane surfaces, said eighths of a sphere having different densities;

bonding a material which reflects radar rays to the plane surfaces of each eighth of a sphere; and bonding the eighths of a sphere together to form the spherical radar reflector.

6. A radar reflector made by the process of:

expansion molding eight individual and identically-shaped eighths of a sphere in a mold having smooth sides, each eighth of a sphere being made of foam material and having three mutually perpendicular plane surfaces;

bonding a material which reflects radar rays to the plane surfaces of each eighth of a sphere; and bonding the eighths of a sphere together to form the spherical radar reflector.

7. A radar reflector made by the process of:

expansion molding eight individual and identically-shaped eighths of a sphere in a mold having smooth sides, each eighth of a sphere being made of foam material and having three mutually perpendicular plane surfaces;

bonding a material which reflects radar rays to the plane surfaces of each eighth of a sphere; and bonding the eighths of a sphere together to form the spherical radar reflector;

wherein the step of bonding a said material which reflects radar rays comprises applying an adhesive having metallic particles and another electrically conductive metal uniformly distributed therein, and wherein said adhesive is applied to the plane surfaces of each eighth of a sphere so as to bond said eighths of a sphere together.

* * * * *